United States Patent [19]

Ishimura et al.

[11] Patent Number: 4,663,508

[45] Date of Patent: May 5, 1987

[54] COMBINATION THERMAL AND MECHANICAL SAFETY SWITCH FOR MICROWAVE HEATING OVEN

[75] Inventors: Yohzoh Ishimura, Kashihara; Okihiko Nakano; Toyotsugu Matsukura, both of Nara; Toshiaki Kanaoka, Kashihara, all of Japan

[73] Assignee: Matsushita Electric Industrial Co., Ltd., Kadoma, Japan

[21] Appl. No.: 810,567

[22] Filed: Dec. 19, 1985

[30] Foreign Application Priority Data

Dec. 20, 1984 [JP] Japan ..... 59-269767
Feb. 15, 1985 [JP] Japan ..... 60-28673

[51] Int. Cl.[4] ..... H05B 6/64

[52] U.S. Cl. ..... 219/10.55 C; 219/10.55 B; 126/197

[58] Field of Search ..... 219/10.55 B, 10.55 C, 219/10.55 D, 10.55 R, 10.55 E; 200/50 A, 50 C; 126/197

[56] References Cited

U.S. PATENT DOCUMENTS 3,715,552 2/1973 Umezu et al. ..... 200/50 A X
3,766,437 10/1973 Fritts ..... 219/10.55 C
4,461,940 7/1984 Ishimura ..... 219/10.55 C

FOREIGN PATENT DOCUMENTS 2949773 6/1981 Fed. Rep. of Germany ..... 126/197

*Primary Examiner*—Philip H. Leung
*Attorney, Agent, or Firm*—Cushman, Darby & Cushman

[57] ABSTRACT

In a microwave heating oven, a safety switch 301 is disposed in an external position relative to a heating chamber 100. A displacement rod 302, which is made of polyprophylene or the like low dielectric constant plastic substance, is disposed through and across the heating chamber 100. Displacement rod 302 serves as a thermal switch, so that at an abnormally high temperature displacement rod 302 melts down, thereby opening the safety switch 301 and disengaging the microwave generator.

9 Claims, 8 Drawing Figures

COMBINATION THERMAL AND MECHANICAL SAFETY SWITCH FOR MICROWAVE HEATING OVEN

BACKGROUND OF THE INVENTION

1. Field of the Invention

The present invention generally relates to heating ovens; for example, electric or microwave heating ovens. The invention particularly relates to microwave ovens having mechanical safety switches linked to respond to the open-close action of their front doors, which mechanical switches also serve as thermally responsive safety switches. Thus, the switches both guard against operation of the microwave when the door is open, and against operation when the microwave is overheated.

2. Description of the Related Art

In the conventional microwave heating oven, a box which constitutes a heating chamber, is further enclosed in an external case. Because of such construction, it is difficult to make such a heating oven at a low cost, or to make such a heating oven easy in manufacture, or to make such a heating oven compact. In order to solve such problems, a heating oven in which the box of the heating chamber serving as the external case has been tried. For example, a heating oven wherein the control box containing electric parts is disposed at the side of the heating chamber, is shown in patent application Sho No. 59-105036, or a heating oven wherein the control box disposed below the heating chamber, is shown in patent application Sho No. 59-119319.

FIG. 1 shows one of such conventional microwave heating ovens. In FIG. 1, the control box 2 containing electric parts is disposed below the heating chamber 1. The front door 3 is disposed at the front opening 1*a* of such heating chamber 1. The front door 3 has a hook 3*a* for locking the front door 3. And the safety switch 7 is disposed at the position involving such hook 3*a* on the side wall of the heating chamber.

FIG. 2 shows a control circuit of such a conventional microwave heating oven. In FIG. 2, the control circuit comprises, a magnetron 31, a high voltage transformer 32, a high voltage capacitor 33, a diode 34, a cooling fan motor 4, a timer control motor 5, and so on. In the safety standard, for example UL standard, at least two safety switches 7 and 8, responsive to the open-close action of the front door 3 must be included in the design of the microwave. Further, a short switch 10 also must be disposed on such electric circuit, to melt down the fuse 9 in case switches 7 and 8 become stuck closed when front door 3 is open. Furthermore, the conventional microwave heating oven has a thermal switch 11 which is, for example, a fuse switch or a bimetal switch, so as to break off the electric circuit for making microwave 30 and the cooling fan motor 4 in case of abnormal high temperature or fire trouble of food. In practical design of the microwave heating oven, the position of the thermal switch is determined after designing of a passage of the exhaust gas from the cooked food by trial and error of the experiment.

As improvement toward simplicity of the configuration of the heating oven proceeds, however, the safety switch responding to the open-close action of the front door must be disposed at the position to be showered by the microwave, which is shown in FIG. 1. So that, such a heating oven has the following problems. First, shower of microwave destroys the safety switch, second at receiving such microwave shower, wires of control circuit radiate electric noise which a badly affect the television set or the radio.

Further, in a microwave heating oven such as shown in patent application Sho No. 59-119319, the walls of the heating chamber serves as the external case, and so the heat is conveyed toward external part easily. Therefore, there is a strong demand for the quick responding thermal switch which can break down the electric circuit in a short time.

SUMMARY OF THE INVENTION

The purpose of the present invention is to provide a microwave heating oven having safety swiches, at least one of which serves dually as a thermal switch.

A microwave heating oven in accordance with the present invention comprises, a heating chamber for containing and heating a heating object therein, a microwave generator for generating microwave for heating the heating object, a front door for covering a front opening part of the heating chamber, a safety switch which is disposed behind a microwave-shield and is for switching off the operation of the microwave generator, responding to opening action of the front door, physical displacement means for transmitting the opening action of the front door to the safety switch, disposed across and through the heating chamber.

As a result of the above-mentioned configuration, the safety switches are safely shielded from the microwave and hence are not broken by the radiation of the microwave, and on the other hand the switch is quickly opened in the event of abnormally high temperatures of fire trouble.

DESCRIPTION OF THE PREFERRED EMBODIMENTS

A preferred embodiment of a microwave heating oven in accordance with the present invention is shown in FIG. 3, FIG. 4, FIG. 5, FIG. 6, FIG. 7 and FIG. 8.

Figure 1:
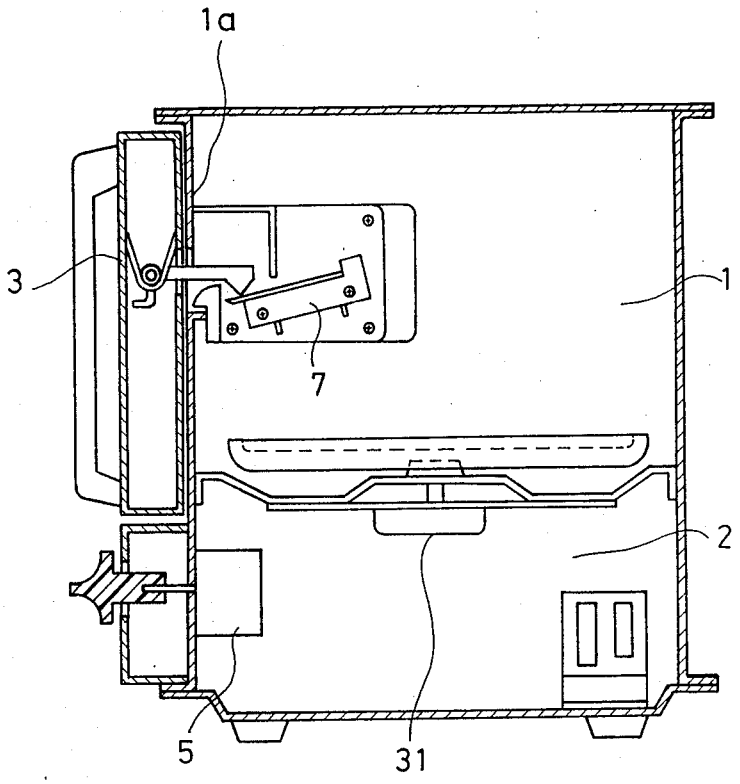
FIG.1 (Prior Art)
FIG. 1 is the cross-sectional side view of the conventional microwave heating oven.
Figure 2:
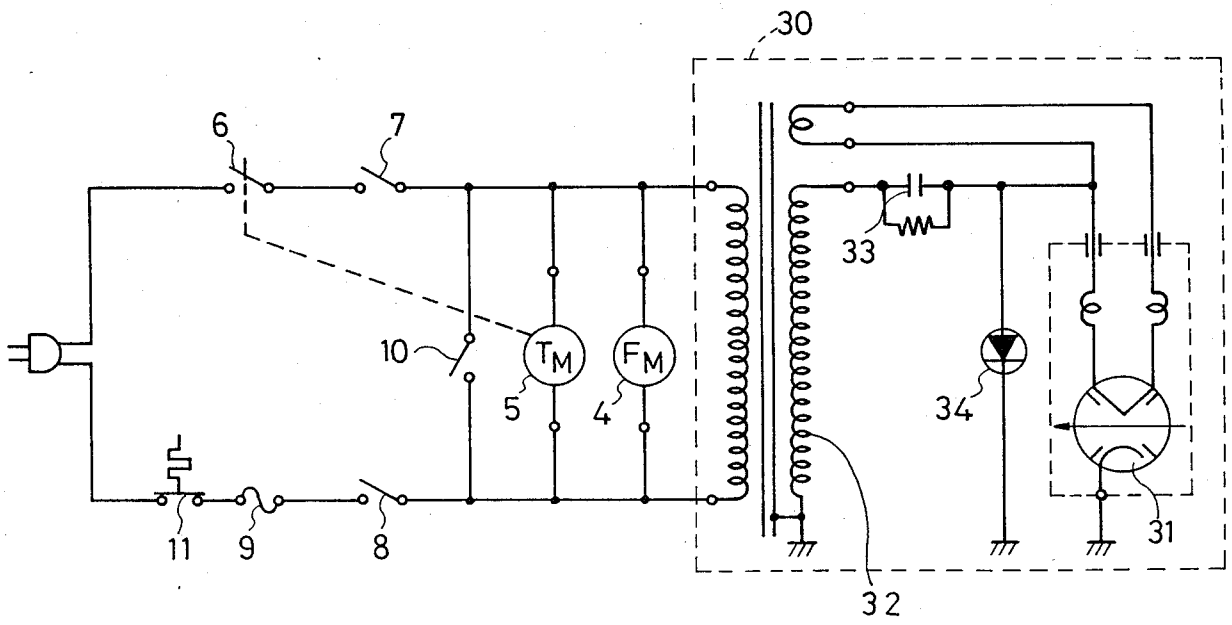
FIG. 2 (Prior Art)
FIG. 2 is the drawing of the electric circuit for making microwave in accordance with the conventional microwave heating oven.
Figure 3:
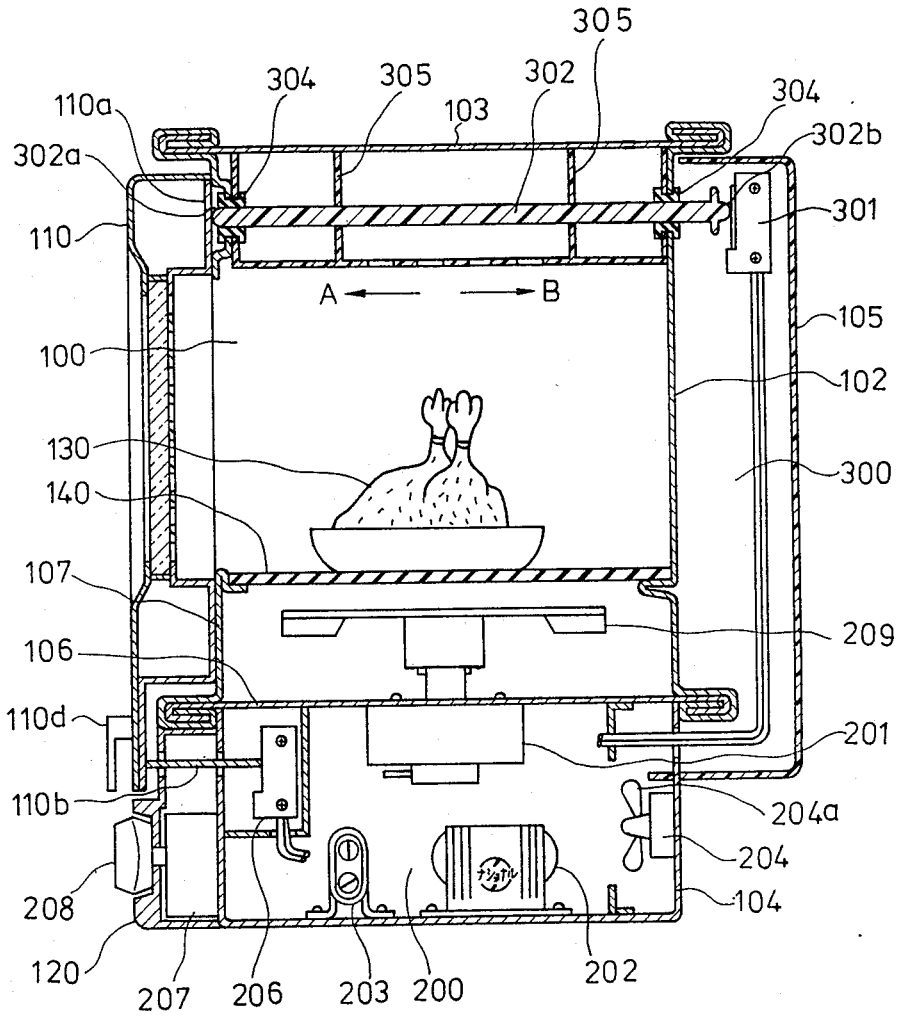
FIG. 3 is a cross-sectional side view of a microwave heating oven in accordance with the present invention.

As shown in FIG. 3, a box made of a microwave-shielding substance, such as metal, and constituting a heating chamber 100 of such embodiment is designed to serve also as an external case, so as to make the size of the microwave heating oven compact and reduce cost. Panels 101, 102, 103, 104, 106, 107 and so on, which are for example stainless steel, are made in box shape by known bending and calking and the like. A control box 200 in which a magnetron 201, a high voltage transformer 202, a high voltage capacitor 203, a cooling fan motor 204, and so on are contained, is disposed below the heating chamber 100. At a front opening window of the heating chamber 100, a front door 110 is connected rotatably to the panel 107 by a known mechanism (which is not shown in the drawings). And a front part of the control box 200 is covered by a control panel 120. A timer 207 for controlling the cooking time, (namely radiation time of microwave,) and a knob of the timer 208 are disposed at the front face of the control panel 120.

Figure 6:
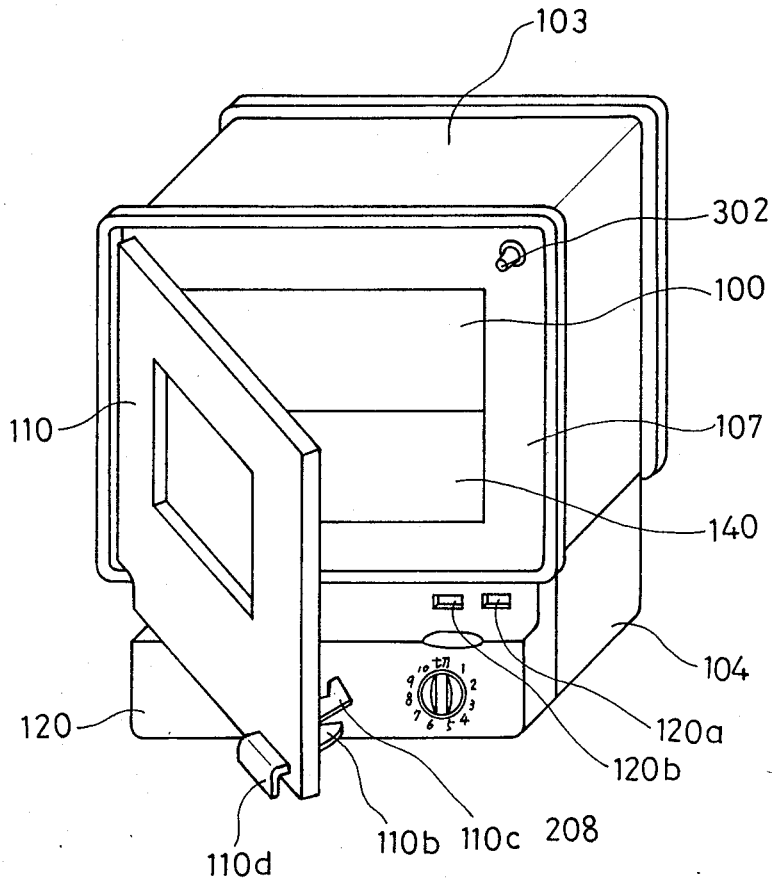
FIG. 6 is a perspective view of a microwave heating oven in accordance with the present invention.

As shown in FIG. 6 which is a perspective view of the heating oven in accordance with FIG. 3, the front door 110 has a projection part 110*b* and a hook part 110*c* on its inner face. The projection part 110*b* turns on a safety switch 206 disposed on the control box 200 when the front door 110 is closed, and turns off the safety switch 206 when the front door 110 is opened. And the hook part 110*c* is caught to be locked and released to be unlocked by a known mechanism in the control box 200, responding to the close action and open action of the door knob 110*d* of the front door 110 (the lock mechanism is not shown in the drawings), respectively.

The control panel 120 has openings 120*a* and 120*b*, respectively for receiving the projection part 110*b* and the hook part 110*c* of the front door 110. And the lock mechanism serves as another safety switch. These mechanism and the safety switches are shown in detail in FIG. 8 and explained later.

A rear cover 105 is fixed on the rear part of the heating chamber 100, and the space 300, which is enclosed by the panel 102 of the heating chamber 100 and the rear cover 105, constitutes the exhaust passage of the heating oven to exhaust the vapor or the like from the food 130 of heating object by the absorption of the cooling fan 204*a*. On the inner face of the rear cover 105, a safety switch 301 which turns off or on responding to the open-close action of the front door 110, is disposed. A displacement rod 302, which transmits the open-close action of the front door 110 to the safety switch 301, is disposed through the upper part of the heating chamber 100. And also, it is supported at both end parts in a direction shown by arrow marks A and B in FIG. 3 by bushings 304 and at inbetween parts by guide holders 305. The guide holders 305 are held by the panels 102 and 103 of the heating chamber 100. The displacement rod 302 is always charged by a spring of safety switch 301 (which is not shown in figures) so as to be pushed out of the panel 107. When the front door 110 is opened, the displacement rod 302 slides in the direction arrowed A by the force of the spring of the safety switch 301 and is pushed out of the panel 107, so that the right end 302*b* of the displacement rod 302 is separated from the safety switch 301, and the safety switch 301 is opened. And when the front door 110 is closed, the inner face 110*a* of the front door 110 contacts with the left end 302*a* of the displacement rod 302, and so, the displacement rod 302 is withdrawed in the direction arrowed B, and the safety switch 301 is closed. Accordingly, the safety switch 301 is responding to the open-close action of the front door 110.

On the bottom of the heating chamber 100, a magnetron 201 which generates the microwave, and a stirrer blade 209 which radiates the microwave equally on the food 130, are disposed. The food 130 is partitioned from the magnetron 201 and the stirrer blade 209 by a partition 140 made of ceramics or the like insulating substance.

The safety swich 301 which is mentioned above, also serves as a thermal switch. The thermal switch is for sensing the abnormal high temperature or heat in the heating chamber 100 caused by the fire trouble of the food or the like, and for cutting off the electric circuit of microwave generating circuit 250 and the cooling fan motor 204, so that the opening of the thermal switch 301 prevents propagation of heat to the outside of the heating oven in an early stage.

The constitution and operation of the thermal switch is as follows.

Figure 4:
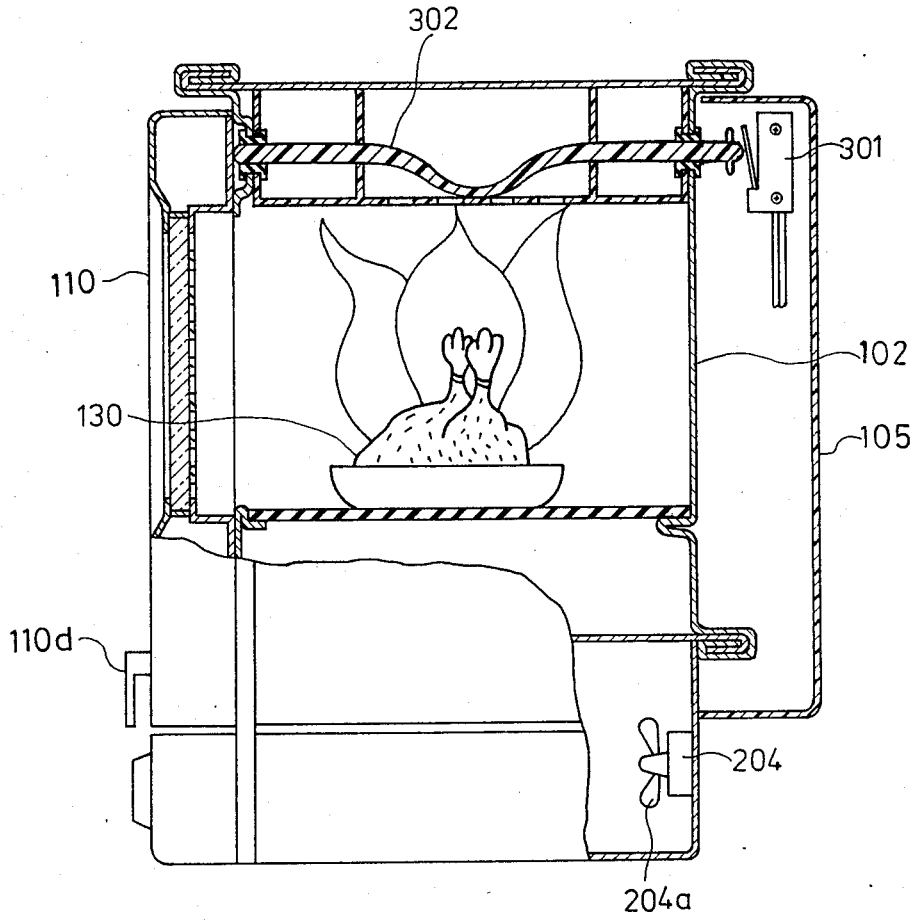
FIG. 4 is a cross-sectional side view of the microwave heating oven in accordance with FIG. 3, showing a case of a fire trouble and action of a safety switch serving as a thermal switch..

The displacement rod 302 is made of low dielectric loss materials such as polypropylene, so that it does not ignite at normal heating temperatures of the microwave, but it easily changes its' shape at abnormally high temperature caused by the fire trouble of the food or the like. Accordingly, in case of the fire trouble of the food which is shown in FIG. 4, the center part of the displacement rod 302 changes its shape, and does not withstand the force of the spring of the safety switch 301 (which is not shown in figures). So, the spring returns to normalcy and the right end 302*b* is pushed in the direction designated by arrow mark A. Then, the safety switch 301 is turned off and cuts off the electric circuit of making microwave 250 and the cooling fan motor 204.

Figure 5:
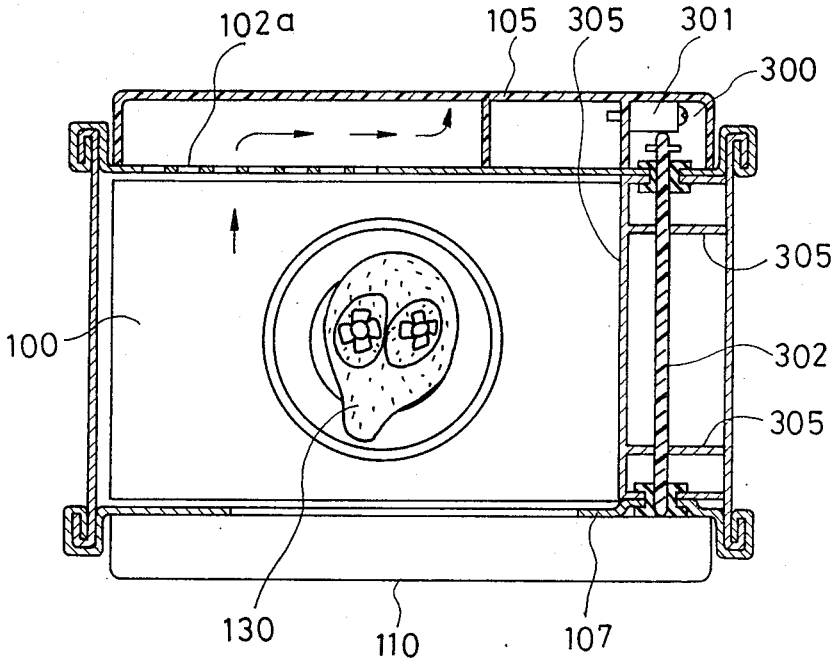
FIG. 5 is a cross-sectional plan view of the microwave heating oven of FIG. 3.

FIG. 5 is a cross-sectional plan view of the heating oven in accordance with FIG. 3.

On the center of the heating chamber 100, the food 130 of heating object is disposed. The displacement rod 302, the guide holder 305 and the safety switch 301 are disposed on the right end part of the heating chamber 100. And also these switching mechanisms is disposed on the upper part of the heating chamber 100, so the heating chamber 100 is hardly restricted by these switching mechanisms. When the microwave radiated the food 130 in cooking, the vapor or the like are produced. Such vapor is drafted through the punched holes 102*a* of the panel 102 in FIG. 5 and exhausted out of the heating oven by the cooling fan 204*a* in FIG. 3. The exhaust passage is shown by the arrow marks.

Figure 7:
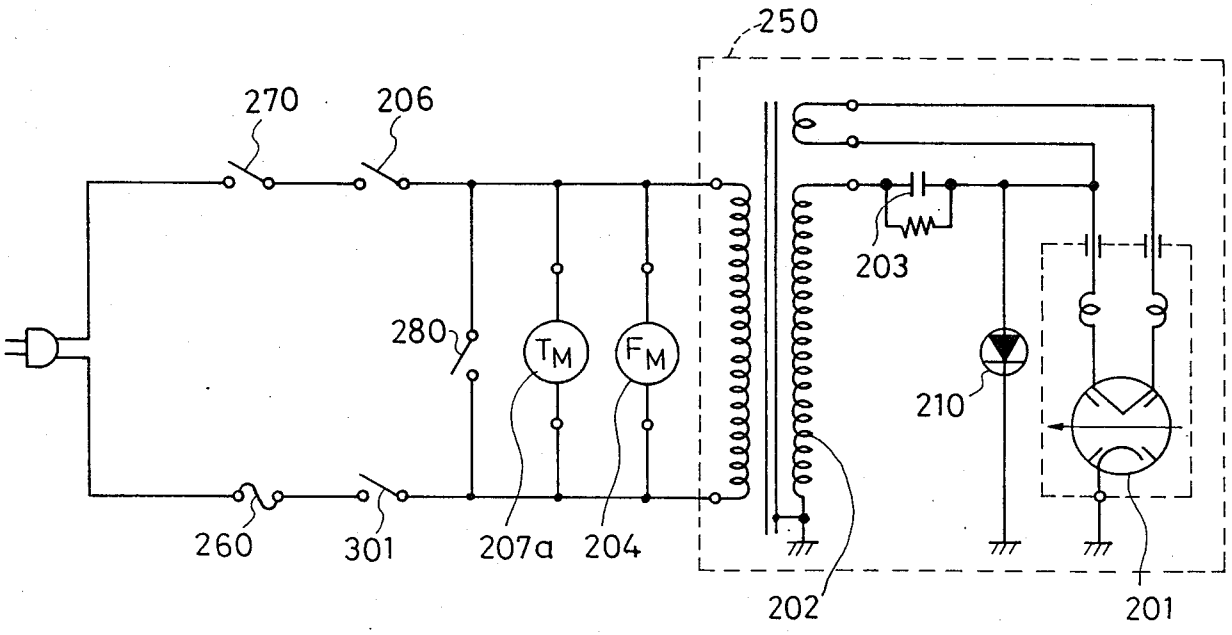
FIG. 7 is a circuit diagram of an electric circuit of the microwave heating oven in accordance with the present invention.
Figure 8:
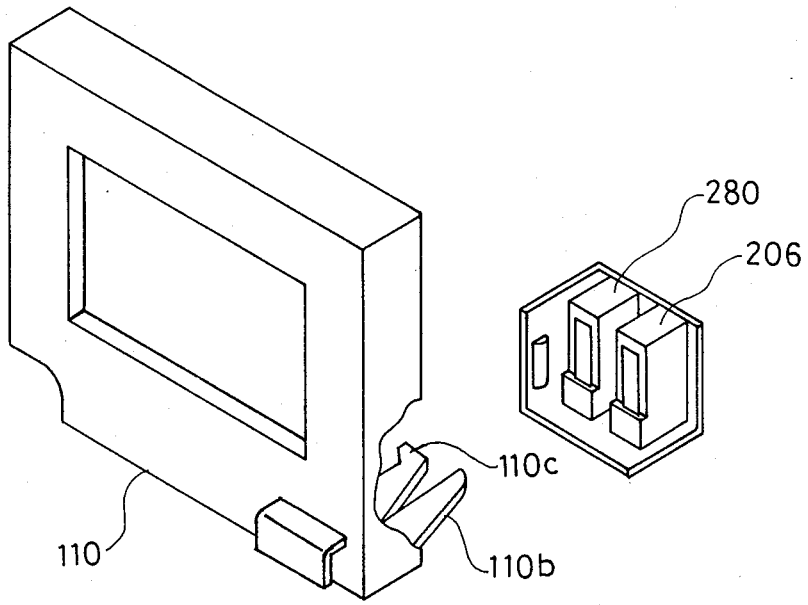
FIG. 8 is a perspective view of a lock mechanism and switches for responding to a front door in accordance with FIG. 6.

FIG. 7 shows an example of the electric circuit of this embodiment of the microwave heating oven. In the electric circuit the above-mentioned at least two safety switches 206 and 301 to comply with the safety standard are provided. The safety switches 206 and 301 are responsive to the open-close action of the front door 110. Further, a-short-circuiting switch 280 is also provided in such electric circuit, to turn on in case of failure of the safety switches 206 and 301, so as to melt down a fuse 260. Incidentally, 270 designates a main switch. As shown in FIG. 8, the short-circuiting switch 280 is provided to connect two power lines at the part beyond other safety switch 206, 301 and a fuse 260 in paralel with loads in this apparatus, and serves as lock mechanism of the front door 110.

In such electric circuit, a timer motor 207*a* of a timer 207 which controls the heating time, the cooling fan motor 204 and an electric circuit for making microwave are connected in paralel. Further, the microwave generating circuit 250 comprises the magnetron 201, the high voltage transformer 202, the high voltage capacitor 203, the diode 210 and so on.

As mentioned above, the present invention uses a thermal switch 301 as one of safety switches, and the safety switches are disposed at a position thermally isolated from the heating chamber, so that the safety switches of the present invention have high reliability. The electric circuit of the present invention has simplicity, and the microwave heating oven can be made without losing the compactness and the low cost, in comparison with the conventional compact type microwave heating oven.

What is claimed is:

1. A microwave heating oven comprising:

(a) heating chamber means with aperture therein, adapted for containing and heating an object placed therein;

(b) heating chamber door means capable of being connected to said heating chamber means so as to cover said aperture;

(c) microwave generator means connected to said heating chamber means so as to irradiate and thereby heat said object;

(d) safety switch means connected to said microwave generator means so that opening said switch means de-energizes said microwave generator means;

(e) physical displacement means connected between said door means and said safety switch means;

(1) said displacement means being connected to that closing said door means causes said displacement means to close said switch means and that opening said door means causes said displacement means to open said switch means, (2) said displacement means being disposed thermally proximate to said chamber means so that overheating of said chamber means causes said displacement means to become overheated, (3) said displacement means being made of a thermally responsive material so as to be rigid at normal operating temperatures of said heating chamber means and yet flexible at overheated temperatures of said heating chamber means, (4) said displacement means being connected between said door means and said switch means so that when said displacement means becomes flexible, said switch means is caused to open.

2. An oven as in claim 1 wherein said switch means is shielded from said heating chamber means by microwave shield means, so that said switch means is thermally insulated from said chamber means.

3. An oven as in claim 2 wherein said chamber means is made from microwave shielding material.

4. An oven as in claim 2 wherein said switch means is disposed near one side of said chamber means opposite to a side thereof adjacent said door means, so that said displacement means passes tangential to one or more other sides of said chamber means as it passes between said door means and said switch means.

5. An oven as in claim 4 wherein said displacement means is made of a low dielectric loss substance.

6. An oven as in claim 4 wherein said displacement means is made of polyprophylene.

7. An oven as in claim 4 wherein said switch means comprises spring loaded electrical switch means, and said displacement means comprises a bar of temperature responsive, low dielectric loss material; so that closing of said door means pushes said displacement means so as to close said spring-loaded switch means, and opening of said door means allows said spring-loaded switch means to push said displacement means back to its original position and thereby open said switch means, and that upon said displacement means becoming flexible, as when said chamber means overheats, said spring-loaded switch means opens, thereby de-energizing said microwave generator means.

8. An oven as in claim 4 wherein said displacement means is located tangential to a side of said chamber means near to the top of said chamber means.

9. An oven as in claim 4 wherein said switch means comprises a plurality of switches, and said displacement means comprises a plurality of displacement bars activating said plurality of switches.

* * * * *